United States Patent [19]

McNamara, Jr.

[11] 4,308,573

[45] Dec. 29, 1981

[54] LAMP FIXTURE INCLUDING DIFFUSED LOW ANGLE REFLECTIVE SURFACES

[75] Inventor: Albert C. McNamara, Jr., San Marcos, Tex.

[73] Assignee: Esquire, Inc., New York, N.Y.

[21] Appl. No.: 914,578

[22] Filed: Jun. 12, 1978

[51] Int. Cl.[3] ..... F21V 7/09

[52] U.S. Cl. ..... 362/297; 362/349

[58] Field of Search ..... 362/217, 292, 296, 297, 362/298, 301, 341, 346, 347, 348, 349, 350, 355, 356, 360, 361, 343; 350/292, 293; 355/67

[56] References Cited

U.S. PATENT DOCUMENTS

| | | | |
|---|---|---|---|
| Re. 17,825 | 10/1930 | Linton et al. | 362/348 |
| 1,370,255 | 3/1921 | Zimmermann | 362/301 |
| 1,413,315 | 4/1922 | Correll | 362/350 |
| 1,429,762 | 9/1922 | Oliver | 362/355 |
| 1,568,942 | 1/1926 | Haley | 362/349 |
| 1,590,130 | 6/1926 | Sturgeon | 362/348 |
| 1,770,726 | 7/1930 | Bauersfeld | 362/348 |
| 1,821,955 | 9/1931 | Wuelkea | 362/346 |
| 2,089,610 | 8/1937 | Kloos | 362/348 |
| 2,143,673 | 1/1939 | Baumgartner | 362/343 |
| 2,242,590 | 5/1941 | Moreau | 362/341 |
| 3,679,893 | 7/1972 | Shemitz et al. | 362/350 |
| 3,701,898 | 10/1972 | McNamera | 362/341 |
| 3,902,059 | 8/1975 | McNamera | 362/349 |
| 4,128,333 | 12/1978 | Levin et al. | 355/67 |
| 4,153,929 | 5/1979 | Laudenschlager et al. | 350/292 |

*Primary Examiner*—L. T. Hix
*Assistant Examiner*—Alan Mathews
*Attorney, Agent, or Firm*—Frank S. Vaden, III; Emil J. Bednar

[57] ABSTRACT

A light reflector system for an elongated light source and having multiple reflective surfaces, some of which are treated for diffusing light, particularly those surfaces that reflect light at low reflective angles, and some of which are specular or, alternatively, treated for light spread reflection, particularly those surfaces that reflect the image of the lamp source at high reflective angles.

20 Claims, 9 Drawing Figures

FIG. 5
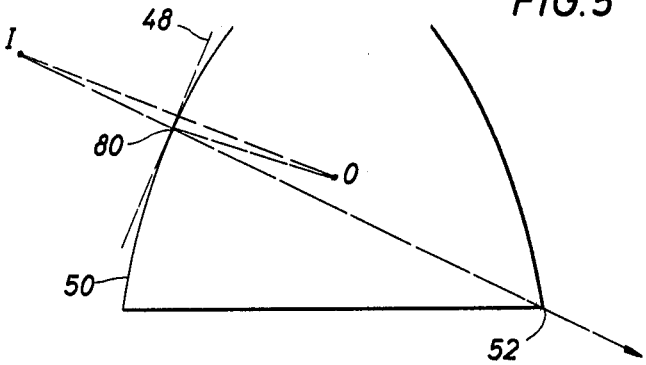
FIG. 6
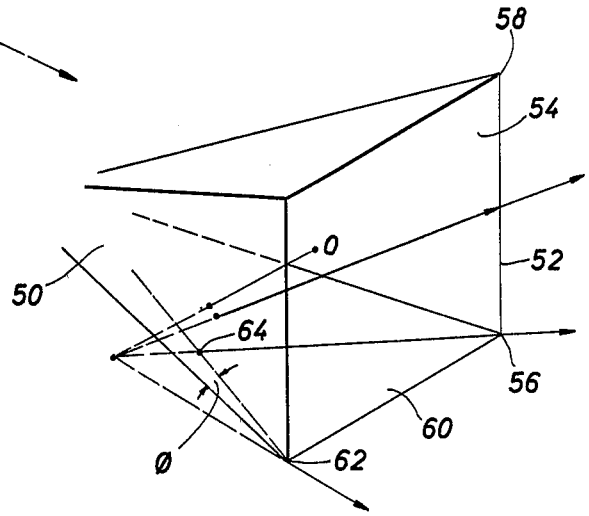
FIG. 7
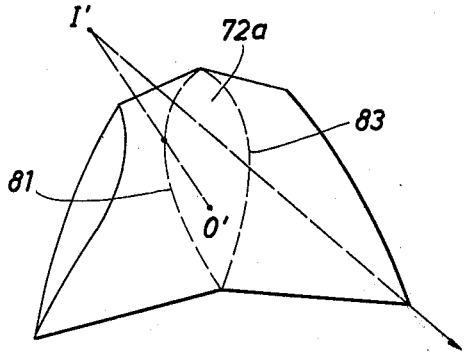
FIG. 9
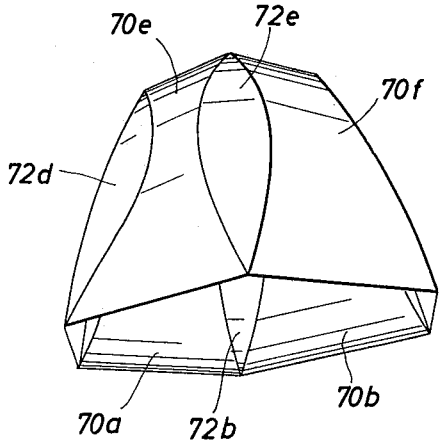
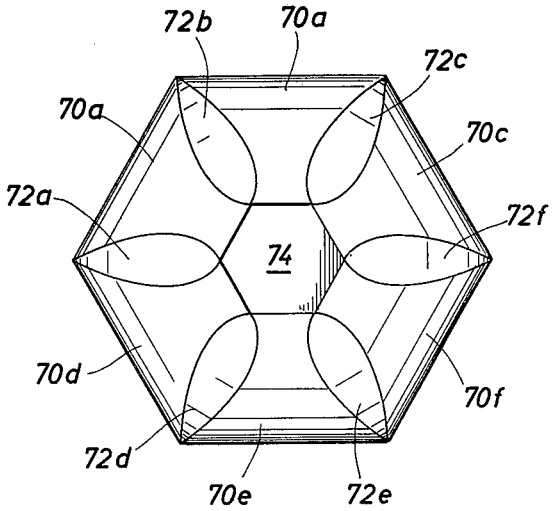
FIG. 8

LAMP FIXTURE INCLUDING DIFFUSED LOW ANGLE REFLECTIVE SURFACES

BACKGROUND OF THE INVENTION

1. Field of the Invention

This invention relates generally to reflective lighting fixtures and more particularly to enhancing the wide spacing of light reflections from those types of lighting fixtures including a plurality of highly reflective surfaces at low angles of reflections.

2. Description of the Prior Art

Efficient light reflection from light fixtures is extremely important, if for no other reason except for conservation-of-energy reasons. In striving to increase light fixture efficiency, designers of the current generation of fixtures have attempted to optimize the arrangement of light reflecting surfaces and have even utilized specular surfaces throughout in anticipation that such a fixture would be the ultimate.

The trend in new fixtures just described has resulted, however, in light fixtures producing light which is spotty or poorly distributed, light that is too focal and light which is not pleasing.

There have been many studies concerning the development of surfaces to diffuse light and to spread light and some fixtures utilize some of these techniques. However, heretofore it has not been appreciated that in a multi-surface reflector system there is an advantage of using on some selected surfaces a diffusing material or surface treatment while on other surfaces it is desirable to use specular surfaces or, alternatively, surface spreading techniques, all while not giving up to any appreciable degree, light efficiency when compared to an all specular lamp fixture.

Therefore, it is a feature of the present invention to provide an improved light reflector having a plurality of surfaces, some of which tend to sharply reflect images of the source at low reflecting angles, with other selected surfaces being specular or, alternatively, being treated for diffusing light.

It is another feature of the present invention to provide an improved light reflector for an elongated source and having a plurality of surfaces, low-angle reflection surfaces having diffusing treatment qualities and other surfaces having specular, or alternatively, light spread reflection qualities, the combination achieving wide spacing of uniform light.

It is still another feature of the present invention to provide an improved light fixture with low reflective angle surfaces treated for diffusing light and high reflective angle surfaces being specular, or alternatively, being treated for light spread reflection.

SUMMARY OF THE INVENTION

A preferred embodiment of the present invention is a light fixture for mounting an elongated light source along the optical axis thereof, the fixture including reflective surfaces, some being treated for a first reflective property and other surfaces being treated for a different property. Those reflective surfaces reflecting the image of the light source at low reflective angles are treated, made, or otherwise caused to have light diffusing qualities. Those reflective surfaces reflecting the image of the light source naturally the least focal, or at high reflective angles, are either specular or are treated, made, or otherwise caused to have light spread reflection qualities. The resulting fixture produces wide spacing and pleasing reflection, thereby avoiding reflections at too sharp a direction, spotty or unpleasing to the eye.

The interplay between the surfaces in the reflector causes diffusion of light from those surfaces otherwise having the lowest angle of image reflection, while not diffusing the light from reflective surfaces producing high angle image reflections.

A preferred diffusing surface is white paint, naturally also having properties for long life under the temperature and other environmental conditions existing in the light fixture. A preferred light spread reflection surface treatment, which still leaves superior spectral qualities, is hammertoning.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiment thereof which is illustrated in the appended drawings, which drawings form a part of this specification. It is to be noted, however, that the appended drawings illustrate only a typical embodiment of the invention and are therefore not to be considered limiting of its scope, for the invention may admit to other equally effective embodiments.

In the Drawings:

FIG. 5 is a schematic representation illustrating formation of the outlet opening of a reflector structure useful in implementing the present invention in accordance with a simplified point light structure.

FIG. 6 is an oblique schematic representation for determining the dimension of corner reflectors in the reflector shown in FIG. 5.

FIG. 7 is a schematic representation illustrating direct and primary reflection of light from the light reflector system shown herein.

FIG. 8 is a plan view of a light reflector constructed in accordance with the schematic illustrations of FIGS. 5 and 6.

FIG. 9 is an isometric illustration depicting the light reflector shown in FIG. 8.

DESCRIPTION OF PREFERRED EMBODIMENT

Figure 1:
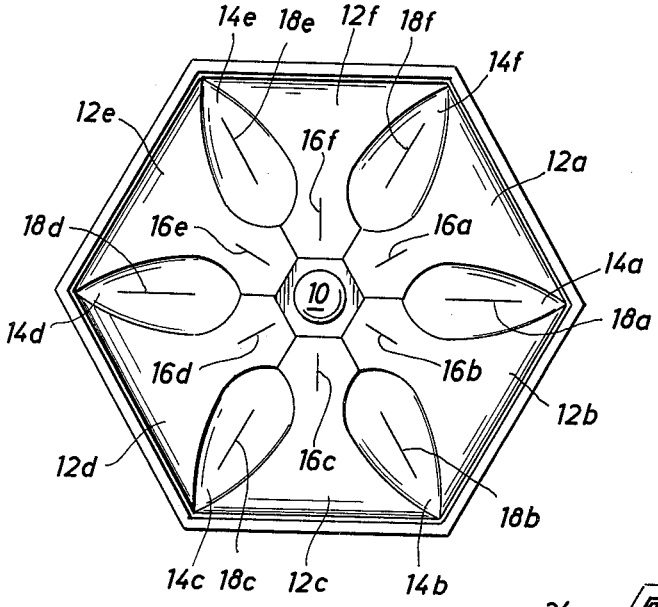
FIG. 1 (PRIOR ART)
FIG. 1 is a plan view into a prior art fixture of which the invention presented herein is an improvement.

Now referring to the drawings and first to FIG. 1, a prior art light reflector structure is shown for carrying a mounted light source 10 therein. Typically, the light source is a 1000-watt, high-pressure sodium arc tube, which has an elongated arc when ignited. One such popular sodium arc tube has an elongated arc when lighted that is $9\frac{1}{4}$ inches long. A 1000-watt mercury-vapor lamp typically has an elongated arc when lighted of about 6 inches. A 1000-watt metal halide lamp has an elongated arc of about $3\frac{1}{2}$ inches. Of course, these are just examples. It does point out, however, that the fixture design is particularly useful with bulbs that have an elongated arc, which nearly all HID lamps do to some degree. Or, in other words, very few lamps approach a point source of light, which most lamp designers assume.

The reflector illustrated in FIG. 1 includes a plurality of surfaces of uniform reflective quality, normally highly specular for high quality reflectors, for imaging and reflecting light emitted from source 10 through the lens opening of the reflector. These surfaces include a first plurality of curved surfaces 12*a*–12*f*, which progress from a generally narrow dimension in the vicinity of the source to a wide dimension at the outer periphery of the fixture. Interposed between surfaces 12*a*–12*f* are slightly curved petal-like surfaces 14*a*–14*f*, having their narrowest parts at the perimeter of the fixture. A more complete description of the basic design of the reflector is set forth in U.S. Pat. No. 3,902,059, the invention therein set forth being that of the same inventor as the present invention and is commonly assigned. The disclosure of the U.S. Pat. No. 3,902,059 patent is incorporated by reference herein for all purposes.

In accordance with the description set forth in U.S. Pat. No. 3,902,059, side reflector surfaces for the reflector shown in FIG. 1 hereof are developed as shown in FIG. 5, which reflect primary light from the source through the reflector opening and which utilize the entire opening of the reflector.

As may be shown in FIG. 5, a theoretical point source is located at O having an image I with respect to side 50. That is, a right angle projection from point O to a plane that is tangent to the curved reflector 50 results in point I being established at an equal distance from the point of tangency of the plane and the curved reflector surface but on the opposite side thereof from point O. As may be shown in FIG. 5, a cross-sectional view of the plane 48 that is tangent to the curved surface 50 shows clearly the right angle relationship between the plane 48 and the projection line, O-to-I.

The exit pupil is the edge of the opening on one side of which primary reflections from a light source are allowed to pass and on the other side of which light rays are blocked. The exit pupil ray, therefore, is a ray along the line drawn between point I and the escape edge of the opening. The exit pupil edge is identified with reference numeral 52.

Now turning to FIG. 6, it is illustrated that the exit pupil rays from point I which are allowed to escape past opposite side 54 after being reflected from side 50 are allowed to escape at corner 56 and corner 58 of side 54 in the plane of the opening. Of course, rays also escape at all points between corners 56 and 58 along exit pupil edge 52.

Exit pupil rays are also permitted to escape from side 60 adjacent side 50 at corner 62 between sides 50 and 60 in the plane at the opening and along the edge between corners 62 and 56.

It will be seen that there are rays within an angle $\phi$ which are not permitted to be emitted through the opening without being further reflected from side piece 60. This angle may be determined by drawing a line from image point I to corner 56, marking the intersection point 64 between that line and plane 50, and then drawing a straight line from corner 62 through point 64.

In similar fashion it is possible to determine the point analogous to 64 in FIG. 6 for each tangent plane such as 48 for curve 50. The locus of the points determines the curve 81 in FIG. 7.

While FIG. 6 represents straight line calculation of the exit pupil rays for determination of the outlet opening, such is intended for purposes of illustration only. Point or line calculations generated from curved reflector surfaces will function in the same manner.

FIG. 9 is an isometric illustration depicting the light reflector of FIG. 8. It may be seen that the reflectors shown herein would naturally carry a lamp with an elongated arc, which would be hidden in the FIG. 9 view and shown as source 10 in FIGS. 1 and 3 hereof.

Figure 2:
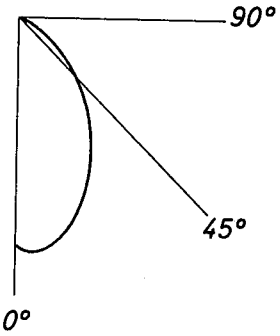
FIG. 2 (PRIOR ART)
FIG. 2 is a diagrammatic representation of the light reflection pattern emanating from the fixture shown in FIG. 1.

Now referring to FIGS. 8 and 9 in detail, it will be seen that corner reflectors may be inserted, each corner reflector or piece being defined by two of the 12 curved lines in adjacent side pieces. For example, corner piece 72*a* lies between curved side pieces 70*a* and 70*d* and is defined by the two curved lines, one on each side piece, drawn to the common corner between side pieces 70*a* and 70*d*. As shown in FIG. 2, corner pieces 70*a*, 70*b*, 70*c*, 70*d*, 70*e* and 70*f* and side pieces 72*a*, 72*b*, 72*c*, 72*d*, 72*e* and 72*f* meet in a six-sided shaped base 74.

Now turning to again to FIG. 5, it should be noted that all rays which are projected at least as forward as the exit pupil ray are allowed to escape at edge 52 (that is, all rays that are at least as forward as the ray from point O intersecting plane 48 at tangent point 80). These rays are all allowed to be emitted through the opening of the reflector following only a single reflection, a primary reflection. This point 80 is determined by making the angle of incidence from point O to plane 48 equal to the angle of reflection such the reflected ray passed through point 52. As is well-known in optical theory, by placing I on the opposite side of plane 48 from O, but at the same perpendicular distance therefrom, a line from I to point 52 intersects plane 48 at point 80. There is no need for the reflecting surface in plane 48 to extend beyond point 80 for the phenomenon to apply. Each of the various points lying in the curved reflector surface may be located graphically by simple determination of the point of tangency between a plane that is tangent to the surface 50. Moreover, the curved reflector surface 50 effectively eliminates the necessity for providing internal back reflectors that would otherwise promote primary reflection of light rays that are blocked by the escape edge 52.

If the reflector construction employed only side reflectors that are joined along curved lines, light reflected by certain edge portions of the side reflectors would not be capable of primary reflection. It is therefore desirable to provide corner reflectors that are positioned and configured to provide primary reflection of light that would otherwise become lost or diffused through multiple reflection. In accordance with FIG. 7 the curved corner reflector surfaces, such as depicted at 72*a* through 72*f* in FIG. 8, are generated by the various points at which the primary reflections fail to be reflected by the side reflector surfaces. A direct ray of light being emitted from point O', the imaginary center of the reflector system at which the light source is located, and passing through a point of tangency of an imaginary plane intersecting the side reflector surface, will pass through the outlet opening of the reflector structure only if the point of imaginary reflection from point I' falls outside of a corner area such that defined by broken lines. It becomes desirable therefore, to provide the reflector structure with corner reflector surfaces that are generated in such a manner that the corner reflectors also provide for primary reflection of light being emitted from the light source. If each point on the side reflector surfaces is generated beyond which primary reflections will not occur, curved lines will be established by the various points, such as illustrated in broken lines at 81 and 83. Within the areas defined by the curved lines 81 and 83, corner reflectors may be disposed, the center of which being oriented in substantially normal relation to direct rays of light being emitted from the point O'.

Near those portions of surfaces 12*a*–12*g* in FIG. 1 in the vicinity of their narrow dimensions are sharply defined images 16*a*–16*f*, drawn as elongated areas since it is assumed, for example, that the images are those of the elongated arc of a long HPS arc tube. It is true that these areas of naturally occuring sharp images produce a low angle reflecting beam from the source through the reflector opening, such as diagrammatically shown in FIG. 2.

The sharply defined image areas 18*a*–18*f* on petal-shaped reflective surfaces 14*a*–14*f* appear to be at higher angles of reflection than are areas 16*a*–16*f*; however, as explained more fully hereinbelow, these surfaces are actually flatter and really reflect at approximately the same low angle as the area in the vicinity of 16*a*–16*f*. The combined reflections from areas 16*a*–16*f* and 18*a*–18*f* are sharp images, mostly at low reflective angles and cause a relatively spotty distribution of light.

Figure 3:
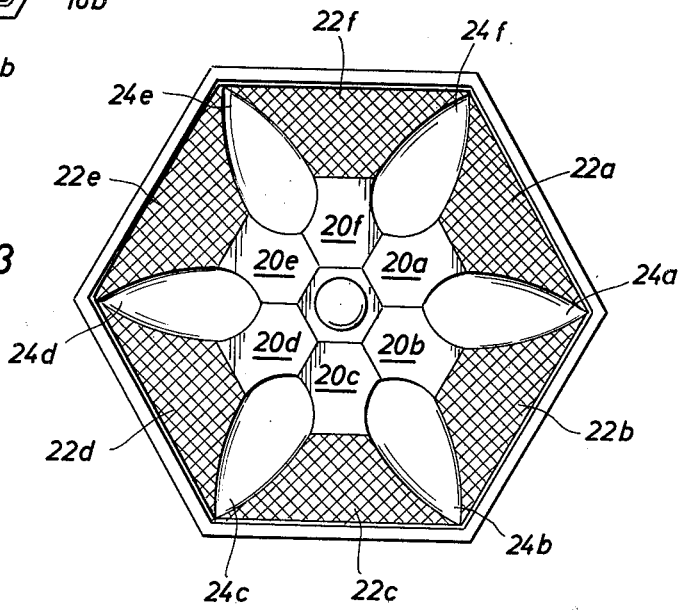
FIG. 3 is a plan view into a preferred embodiment of the present invention.

Now turning to FIG. 3, it is assumed that the same shape of reflector fixture exists as that shown in FIG. 1. The reflector accommodates bulb source 10 and includes reflective surfaces corresponding to reflective surfaces 12*a*–12*f* and 14*a*–14*f*. However, it should be noted that the surfaces corresponding to 12*a*–12*f* may each be conveniently thought of as comprising a low-angle reflective portion 20 (consecutively numbered 20*a*–20*f* to correspond with 12*a*–12*f*) and a high angle reflective portion 22 (consecutively numbered 22*a*–22*f* to correspond with 12*a*–12*f*). The petal-shaped reflective surfaces of the FIG. 3 embodiment are consecutively numbered 24*a*–24*f* to correspond with 14*a*–14*f*.

It has been discovered that the making of the surfaces which reflect at low angles and naturally reflect a sharp image in the prior art embodiment of FIG. 1 so that they diffuse light is a great aid in achieving wider spacing of the reflected light from the fixture. The surfaces employing this treatment include not only the areas 20*a*–20*f*, but also petal portions 24*a*–24*f*.

Figure 4:
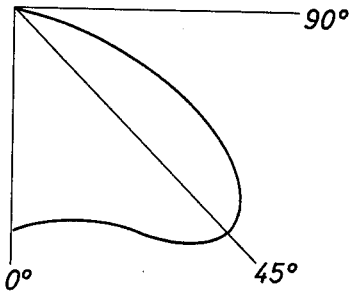
FIG. 4 is a diagrammatic representation of the light reflection pattern emanating from the fixture shown in FIG. 3.

It has further been discovered that treating the surfaces which do not naturally reflect at low angles, namely surfaces 22*a*–22*f*, for light spread reflection improves the wide spacing of the resulting reflections even further. Instead of the low angle lobe on the reflecting beam for the prior art fixture, such as illustrated in FIG. 2, there is a spreading beam at a much wider angle, as illustrated in FIG. 4.

Diffusion and light spread reflection are words of art. "Diffusion", sometimes also referred to as "scatter", is that property of a surface which breaks up light incident from any certain angle and reflects it throughout a complete hemisphere in a generally cosine pattern. This phenomenon, known as Lambert's law, is said to be produced submicroscopically by irregularities smaller than the wavelength of light. The theoretically perfect diffuse surface, known as a Lambert surface, would appear equally bright from any viewing angle, independent of the angle of incident light. Some of the most practically useful diffuse surfaces are porcelain enamelled steel, flat white paint, white paper or plastic, and magnesium oxide (having extremely high reflectance). All real surfaces possess some specular component of reflection. This small component from predominantly diffuse surfaces can be troublesome; however, it can be substantially reduced by abrading, etching or flocking the surface. Also, specially developed matte white (or black) paints have appeared commercially which are velvety and suppress specular reflections to an extreme degree.

Light spread reflection is that type which breaks up an incident beam into a broadened reflected pencil of light through restricted angles. Spread reflection is best produced and controlled by patterning, figuring, embossing, or peening of a specular surface, although useful spread can often be obtained from the natural coarseness of unpolished surfaces if the reflectance is adequate. However, the chemical etching of a specular metallic surface to gain spread is usually self-defeating, as it merely superimposes a broad diffuse component upon a narrower specular one, yielding neither fish nor fowl, and spoiling the reflector.

By impressing or molding carefully designed patterns on polished specular surfaces, it is possible to control the spread of light in nearly any desired manner.

The most commonly used spreading pattern subject to amplitude control is the positive or negative spherical segment, or peen.

An unlimited variety of spreading patterns through peening is available to the reflector designer. Spherical peening provides a general softening of the striations or irregularities in a beam arising from filament images or reflector surface irregularities. Much depends on the light source shape reflected in the image. It is sometimes important to spread out a sharp peak of intensity in the center of a reflector beam, in which case radial circular grooves are effective.

If the light source itself is relatively large, conical peens will give better diffusing with the least enlargement of the pattern. Radial V-grooves having one side which is steep have been used effectively in symmetric street light reflectors to eliminate concentrations of reflected flux through the lamp stem or filament without appreciably altering the total beam. Oval peens have been used for selective diffusion in radial and tangential directions, and to equalize diffusion in reflector surfaces having compound curvatures. The peens in such cases are ovals with the orthogonal radii calculated on the two principal curvatures of the surface, respectively.

In order to allow for the usual gradual changes in radius of curvature of a reflector surface, the average peen diameter can be appropriately graduated. It has been found inconvenient or impracticable to make peens much smaller than 0.015 inch average diameter or much larger than 0.150 inch. If the change in curvature requires peens approaching these values, it is advantageous to change peening tool diameters in judiciously selected steps.

The resulting specular reflector surface treated in the above-discussed manner is known as a hammertoned surface and the process of treating the surface is known as hammertoning.

The combination of diffusing the sharp images and light spread reflecting in the respective areas discussed above achieves an overall efficient and eye-pleasing wide spacing of the reflected light that avoids the prior art problems discussed above. Although, as discussed below, it is not necessary to treat surfaces 22*a*–22*f*.

Suitable paints that have been successfully employed as the diffusing material are sold under the trade names Lucite 43 and Lucite 44 and are roughly, by weight, methyl ethyl ketone, 13%; mixed xylene isomers, 39.5%; acrylic resin, 32.5%; and pigment, ($TiO_2$), 15%. The acrylic resin may be either propyl- or butyl-methacrylate polyester. Other suitable paints may also be used, which are well known in the art, so long as they possess the desirable properties or characteristics which are specified herein. These include good light diffusing capability, durability under lamp operating condition, and resistance to change in diffusing property because of aging.

The treatment or making of the surfaces just described may be achieved by either directly treating the respective surfaces in the prescribed manners, or by treating separate pieces or surfaces and attaching or affixing these treated surfaces in the desired locations.

Now referring to the optical properties of the fixture illustrated in FIG. 3, one of the most efficient light reflectors known is in the shape of an elliptic paraboloid. The surface of an elliptic paraboloid may be formed by revolving a parabola about its axis. An important optical property of such a surface is that it will primarily reflect in parallel or collimated rays all light directed to it from a source located at the focus of the paraboloid of revolution, these rays being parallel to the optical axis of the paraboloid. Such a reflector is ideal for a spot light design, but for a general area light, such reflector is too focal. Therefore, in designing a general area light fixture, the curved surfaces are generally curved so that the light rays reflect, not parallel to the optical axis of the fixture, but at an angle thereto. Nevertheless, light from a source reflecting off an area of a curved surface is reflected in rays that are approximately parallel to each other, rather than being scattered. If the angle of reflection is such that these light rays are approximately parallel to the axis of the fixture, these reflections are referred to as being at a low angle. Similarly, light reflections at an appreciable angle to such axis are at a high angle.

Assuming a curved specular reflector and a point source of light at the focus of the fixture, light is reflected at a nominal angle. Further assuming the same specular reflector and a long source positioned along the axis, the center of the source being at the focus, light emanating from the end deepest within the fixture will reflect light at a preponderance of low angles compared to the nominal angle. Light emanating from the end nearest the opening will reflect light at a preponderance of high angles.

The high angle reflections are sufficiently non-focal that a highly reflective surface in this part of the reflector is efficient without being displeasing. Therefore, surfaces 22*a*–22*f* can be specular or hammertoned. Sections 20*a*–20*f*, on the otherhand, are desirably treated for diffusing light.

A light fixture having curvilinear surfaces generally, but with corner "petal" surfaces for increasing the amount of primary reflection from the fixture, each terminating in a point or near a point at the fixture opening, has a different reflection property for such petal surfaces than the reflection property for the curvilinear surfaces. As may be seen by FIGS. 3 and 5 of U.S. Pat. No. 3,902,059, these petal surfaces tend to be much flatter than the curvilinear surfaces and therefore reflect at a lower angle for the same source. With reference to the embodiment shown in FIG. 3, it is desirable to treat petals 24*a*–24*f* for diffusing light because of the natural tendency of these surfaces to reflect at low angles. Hence, it may be seen that there are two sets of low angle reflective surfaces, one relatively toward the center of the reflector and one toward the periphery. It is desirable that both of these sets of surfaces are paint coated, covered by a covering treated by hammertoning or otherwise treated to cause diffusion of light.

The treatments of the surfaces in the manner explained above work together to produce a superior light quality. The diffusing surfaces break up the highly-reflective, low-angle images and the surfaces not normally having high image reflections may be either left in a specular condition or treated to cause light spread reflections. The result is that the fixtures do not produce too many footcandles straight down, requiring more fixtures in a given area than fixtures treated in accordance with the present invention. Also, the light is less spotty and more pleasing.

While a particular embodiment of the invention has been shown, it will be understood that the invention is not limited thereto. For example, the illustrated fixture shows twelve separate surfaces, each slightly curved. Reflectors with a lessor or greater number of surfaces, some or all of which are not curved, would have the spacing of their light reflections widened and hence enhanced following the teachings of the disclosure herein.

Also, it has been assumed for discussion purposes that the fixture described herein would accommodate a high pressure sodium vapor lamp bulb. The invention is not limited to such a bulb, however, but the invention is most suitable in conjunction with a bulb or source that has an elongated light source along the optical axis of the reflector.

What is claimed is:

1. In a light fixture having a light source and a reflector with a plurality of reflecting surfaces, a first group of said surfaces reflecting light from said source at low angles in directions substantially focally from the fixture and a second group of said surfaces reflecting light from said source at substantially high angles to the focal direction, the improvement comprising said first group of surfaces being toward the center of the reflector, reflecting light in substantially focal directions, and being diffusively treated with respect to said second group of surfaces so as to produce a wider reflecting beam spread from the fixture than the reflecting beam spread from a fixture of like reflecting surfaces without any diffusively treated surfaces.

2. The light fixture in accordance with claim 1, wherein said second group of surfaces is treated to produce specular light reflections.

3. The light fixture in accordance with claim 1, wherein said first group of surfaces approximately defines an elliptic paraboloid and said source is located in said fixture at approximately the focus of the paraboloid of revolution.

4. The light reflector in accordance with claim 1, wherein said first group of surfaces includes paint coating for causing image diffusion.

5. The light reflector in accordance with claim 1, wherein said first group of light reflecting surfaces includes a first set of relatively curved surfaces toward the center of the reflector and a second set of relatively flattened surfaces toward the periphery of the reflector.

6. The light reflector in accordance with claim 1, wherein said second group of surfaces includes hammertoning for causing light spread reflection.

7. In a light fixture having a light source and a reflector with a plurality of reflecting surfaces, a first group of said surfaces toward the center of the reflector reflecting light from said source at low angles in directions substantially focally from the fixture and a second group of said surfaces relatively distant from the center of the reflector reflecting light from said source at substantially high angles to the focal direction, the improvement comprising light diffusing means added to said first group of reflecting surfaces, and light specular means added to said second group of reflecting surfaces.

8. The light reflector in accordance with claim 7, wherein said light diffusing means includes paint added to said first group of reflecting surfaces by coating.

9. The light reflector in accordance with claim 7, and including hammertoning said second group of reflecting surfaces for increasing the high angle reflections therefrom.

10. The method for establishing a wider reflecting beam spread from a light fixture having a reflector with a first group of reflecting surfaces toward the center of the reflector that directs reflective light from a source in said fixture in low angle directions substantially focally from the fixture and having a second group of reflecting surfaces that directs reflective light from said source at substantially high angles to the focal direction, including causing the low reflecting angle surfaces where sharp imaging naturally occurs to have light diffusing characteristics, and causing the high reflecting angle surfaces to have light spreading characteristics.

11. The method in accordance with claim 10, wherein the low reflecting angle surfaces are covered with a substance having light diffusing characteristics.

12. The method in accordance with claim 11, wherein said substance is white paint.

13. The method in accordance with claim 10, wherein said high reflecting angle surfaces are treated by hammertoning.

14. The method in accordance with claim 10, wherein said high reflecting angle surfaces are covered by a covering treated by hammertoning.

15. The method for establishing a wider reflecting beam spread from a light fixture having a reflector with a first group of reflecting surfaces toward the center of the reflector that directs reflective light from a source in said fixture in low angle directions substantially focally from the fixture and having a second group of reflecting surfaces that directs reflective light from said source at substantially high angles to the focal direction, including making the low angle reflecting surfaces of the reflector of light diffusing material, and making the high angle reflecting surfaces of the light reflector of specular material.

16. The method of making a light reflector in accordance with claim 15, wherein the specular material is hammertoned.

17. In a light fixture having a light source and a reflector with a plurality of reflecting surfaces, a first group of said surfaces reflecting light from said source at low angles in directions substantially focally from the fixture and a second group of said surfaces reflecting light from said source at substantially high angles to the focal direction, the improvement comprising said first group of surfaces being wider toward the center of the reflector and narrowing toward the periphery, said second group of surfaces being respectively at least partially between said first group of surfaces, said first group of surfaces reflecting light in substantially focal directions and being diffusively treated with respect to said second group of surfaces so as to produce a wider reflecting beam spread from the fixture than the reflecting beam spread from a fixture of like reflecting surfaces without any diffusively treated surfaces.

18. In a light fixture having a light source and a reflector with a plurality of reflecting surfaces, a first group of said surfaces being wider toward the center of the reflector and narrowing toward the periphery, a second group of surfaces being at least partially respectively between said first group of surfaces, said first group of said surfaces reflecting light from said source at low angles in directions substantially focally from the fixture and said second group of said surfaces reflecting light from said source at substantially high angles to the focal direction, the improvement comprising light diffusing means added to said first group of reflecting surfaces.

19. The method for establishing a wider reflecting beam spread from a light fixture having a reflector with a first group of reflecting surfaces wider toward the center of the reflector and narrowing toward the periphery that directs reflective light from a source in said fixture in low angle directions substantially focally from the fixture and having a second group of reflecting surfaces that directs light from said source at substantially high angles to the focal direction, including causing the low reflecting angle surface where sharp imaging naturally occurs to have light diffusing characteristics, and causing the high reflecting angle surfaces to have light spreading characteristics.

20. The method for establishing a wider reflecting beam spread from a light fixture having a reflector with a first group of reflecting surfaces wider toward the center of the reflector and narrowing toward the periphery that directs reflective light from a source in said fixture in low angle directions substantially focally from the fixture and having a second group of reflecting surfaces that directs reflective light from said source at substantially high angles to the focal direction, including making the low angle reflecting surfaces of the reflector of light diffusing material, and making the high angle reflecting surfaces of the light reflector of specular material.

* * * * *

UNITED STATES PATENT AND TRADEMARK OFFICE

CERTIFICATE OF CORRECTION

PATENT NO. : 4,308,573

DATED : December 29, 1981

INVENTOR(S) : Albert C. McNamara, Jr.

It is certified that error appears in the above-identified patent and that said Letters Patent are hereby corrected as shown below:

Column 5, line 9, change "12a-12g" to -- 12a-12f --.

Signed and Sealed this

*Ninth* Day of *March 1982*

[SEAL]

*Attest:*

GERALD J. MOSSINGHOFF

*Attesting Officer*

*Commissioner of Patents and Trademarks*